US005473501A

United States Patent [19]

Claypool

[11] Patent Number: 5,473,501

[45] Date of Patent: Dec. 5, 1995

[54] LONG RANGE ELECTRICAL STUN GUN

[76] Inventor: James P. Claypool, 1044 Cook Ave., East, St. Paul, Minn. 55106

[21] Appl. No.: 220,278

[22] Filed: Mar. 30, 1994

[51] Int. Cl.[6] ..... F41F 1/00; H05C 1/04

[52] U.S. Cl. ..... 361/232; 89/1.11; 102/201; 42/1.08

[58] Field of Search ..... 361/230, 231, 361/232, 235; 273/84 ES; 89/1.11; 250/214 R, 214.1; 42/84, 1.08; 102/201, 501, 517

[56] References Cited

U.S. PATENT DOCUMENTS

| | | | |
|---|---|---|---|
| 1,754,950 | 4/1930 | Hénocque et al. | 89/1.11 X |
| 3,374,708 | 3/1968 | Wall . | |
| 3,523,538 | 8/1970 | Shimizu . | |
| 3,719,829 | 3/1973 | Vaill | 89/1.11 X |
| 3,803,463 | 4/1974 | Cover . | |
| 3,971,292 | 7/1976 | Paniagua | 89/1.11 |
| 3,975,632 | 8/1976 | Glass et al. | 250/214 SG |
| 4,253,132 | 2/1981 | Cover | 361/232 |
| 4,453,196 | 6/1984 | Herr | 361/232 |
| 5,081,900 | 1/1992 | Buntzen et al. | 89/1.11 |

FOREIGN PATENT DOCUMENTS

| | | | |
|---|---|---|---|
| 493479 | 8/1919 | France | 361/232 |

*Primary Examiner*—A. D. Pellinen
*Assistant Examiner*—Fritz M. Fleming
*Attorney, Agent, or Firm*—Haugen and Nikolai

[57] ABSTRACT

A wire-less dart adapted to be projected by a gun and capable of applying an electrical pulse of sufficient energy to stun a target. The dart includes a photovoltaic cell responsive to a coherent electromagnetic energy source, such as a laser, for converting the beam energy to an electrical pulse. The dart also includes a pair of barbs extending from its distal end which penetrate the target's skin to a non-injurious depth. These barbs serve as electrodes and deliver the electrical pulse to the target. The projector, such as a gun, includes a pulsed laser light source which is aimed at the same location as the projector. Accordingly, the laser source focuses the pulsed laser energy source upon the dart PV cell. The projector includes a propellant sufficient to launch the dart, but with only enough kinetic energy such that the dart barbs penetrate the assailant's skin. The device has a long operating range.

11 Claims, 1 Drawing Sheet

LONG RANGE ELECTRICAL STUN GUN

BACKGROUND OF THE INVENTION

The present invention relates generally to a long range electrical stun gun, and more particularly to a combination gun and projectile or dart capable of converting a laser beam projected thereupon to a high-voltage electrical pulse for stunning an assailant.

DISCUSSION OF THE PRIOR ART

Law enforcement personnel need to be equipped and prepared to respond to many situations. In many instances, lethal weapons and countermeasures are inappropriate, and the use of which may be unlawful. In many domestic disturbances, for example, it is necessary to arrest and apprehend a citizen without using deadly force. Some citizens become so violent that they are unapproachable without risking serious injury to an arresting police officer. In these situations, it is desirable to effectively calm the individual without risking injury to others, especially those proximate to the situation, while using reasonable force against the individual.

There are many prior art devices available which can be implemented by law enforcement personnel, each appropriate for a given situation. Tear gas is one such example. Another device is known as the Tazer Dart, this device being disclosed in U.S. Pat. No. 4,253,132 and the teachings of which are incorporated herein by reference. This dart comprises a sharpened projectile projected from a gun or the like, this dart having a trailing wire electrically connected back to the gun. After this dart is projected and penetrates an intended individual's skin, an electrical source at the gun transmits electrical energy over this wire to stun and immobilize the individual via the dart. The drawbacks of this device are that a trailing wire is implemented to create a tethered dart. This trailing wire may unspool improperly, become severed, and reduce the accuracy of the projected dart. In addition, it increases the complexity of the device.

OBJECTS

It is accordingly a principle object of the present invention to provide a long range electrical stun gun which is wireless.

It is a further object of the present invention to provide an improved projectile which can deliver high-energy electrical pulses to stun an intended individual without risking serious and permanent damage to the individual.

Still a further object of the present invention includes providing a projectile adapted to be projected and operable at long ranges, preferably, in excess of 25 feet without degradation and system performance.

Another object of the present invention is to provide an improved combination gun and projectile which is affordable, reliable, and easy to use.

SUMMARY OF THE INVENTION

The foregoing objects and advantages of the present invention are achieved by providing a dart projectile having an integral photovoltaic cell for converting laser energy focused thereupon to high-voltage stun pulses. Specifically, a dart suited to be projected by a conventional gun has a photovoltaic (PV) cell at a proximal end, and a pair of barbs at the distal end. This PV cell converts a coherent electromagnetic radiation (laser beam) to an electrical voltage, this voltage then being delivered to an individual via the barbs also serving as electrodes. A laser source is provided atop the gun, this source being aimed at the same target as is the gun and powered by an auxiliary power source. Consequently, as the dart is delivered by the gun to an intended individual, the laser focuses a pulsing high-energy coherent electro-magnetic beam at the dart's PV cell. The PV cell converts this monochromatic light beam pulse into a powerful electrical pulse which is delivered via the electrodes. The intended individual is stunned and rendered immobile for a short time, allowing law enforcement personnel to apprehend the individual. The projectile barbs are the only portion of the projectile which penetrates the individual's skin, this penetration being a non-injurious depth.

In a preferred embodiment, the laser source emits a laser beam having a wavelength of 1540 nm. This wavelength possesses little hazard to the human eye should it be aimed into an individuals face by accident. The PV cell generates a photovoltage pulse having a potentional of approximately 10,000 volts, in response to this laser beam. The pulse width of the voltage potential corresponds to the pulse width of the laser pulse, and is only approximately 2 milliseconds. Preferably, this cell is comprised of a concentrator cell. The energy of the laser beam is at least one Joule, this energy being sufficient to incapacitate a typical human body without causing permanent damage. The pulse width delivered to the individual also depends largely on the amperage which is delivered to the individual. The higher the impedance between the electrodes once penetrating an individual's skin, the longer the pulse width.

The projectile is capable of being ejected from a projector using many types of propellant, such a $CO_2$, nitrocellulose, and the like. The projector may comprise of many types of units including single shot, semi-automatic, rapid fire machine guns, pyrotechnic or smokeless powder, and the like. The maximum operating range for this projectile is limited only by the laser spot diameter, and the ability of the user to effectively focus the laser on the PV cell. The laser can comprise the many types including pulsed, continuous wave (CW), solid state, free electron, gas excimer, dye, junction diode, etc. The PV detector cell needs only to be matched to the laser source wavelength, and be capable of withstanding laser energy levels.

BRIEF DESCRIPTION OF THE DRAWINGS

The objects and advantages of the present invention can be appreciated upon a detailed reading of the following detailed description of the preferred embodiment in view of the various figures, were in like numerals in the figures refer to like elements.

DESCRIPTION OF THE PREFERRED EMBODIMENT

Figure 1:
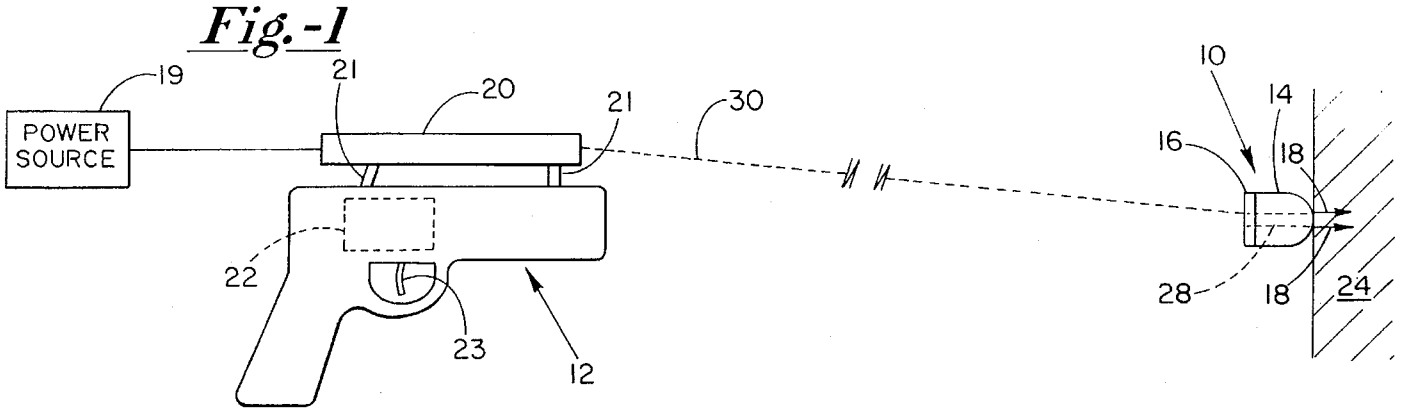
FIG. 1 is an elevational view of a gun projector with a laser source mounted thereupon, and a dart projectile having been projected there from and penetrating the skin of an intended recipient, the proximal end of this projectile having an exposed photovoltaic (PV) cell for converting laser energy focused thereupon to electrical energy for stunning the individual.

Referring now to FIG. 1 a dart projectile generally shown at 10 projected by a gun 12 is shown. Dart 10 has an aerodynamic shroud 14, a photovoltaic (PV) cell 16 bonded across the proximal end thereof, and a pair of barbs 18 projecting form the distal end thereof, as shown. Barbs 18 serve to penetrate the skin of an intended target to a non-injurious depth when launched thereagainst. These barbs also serve as electrodes for conveying and delivering a large voltage pulse to stun the intended target. Photovoltaic cell 16 converts a laser light energy source to an electrical energy, this electrical energy then being electrically communicated to electrodes 18 and delivered to the target.

Gun 12 is seen to include a laser energy source 20 positioned along the upper surface thereof via a pair of supports 21. This energy source 20 is preferably comprised of a diode laser emitting a coherent light beam (laser) at a near-infrared wave-length of 1540 nm. This laser source is powered by an auxiliary power source 19 which can be mounted on a waist belt, or stored in a backpack and the like. This laser beam source is calibrated to focus at the same point as is gun 12. Gun 12 is seen to include a propellant, as shown in phantom at 22, such as $CO_2$, nitrocellulose, etc. Projectors 12 of this type are well known in the art for launching projectiles, such as the dart of the present invention shown at 10.

In operation, gun 12 can be fired by trigger 23 to launch darts 10 at an intended recipient, such as that shown generally at 24. However, the propelling force is sufficient to cause only barbs 18 to pierce the skin's surface of the target 24. The aero-dynamic shroud 14 will not penetrate the skin's surface, thus avoiding serious injuries. In other words, the propelling mechanism 22 can only launch dart 10 with a sufficient kinetic energy to cause barbs (electrodes) 18 to pierce the target's skin.

Figure 2:
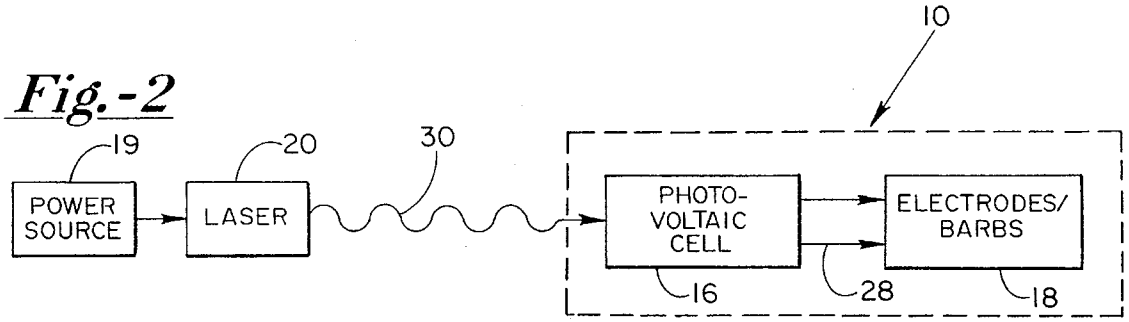
FIG. 2 is an electrical block diagram of the present invention illustrating the PV cell converting the laser source energy to electrical energy and delivered to the electrodes penetrating the individual's skin.
Figure 3:
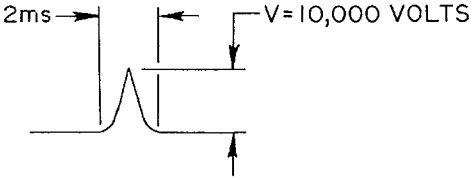
FIG. 3 is a graph of the electrical pulse delivered to the individual.

As shown in FIG. 1, dart 10 has an aero-dynamic profile. Shroud 14 is a rigid, non-conductive, hollow housing with a round disc-like photovoltaic cell 16 being bonded to the proximal end thereof about a perimeter of the PV cell 16 with an electrically non-conductive adhesive. Referring to FIG. 2, an electrical block diagram of dart 10 is shown. PV cell 16 is shown to be coupled to electrodes/barbs 18 via a pair of electrically isolated conductors 28, these conductors extending internal to shroud 14. PV cell 16 is responsive to a pulsed laser beam 30 generated by laser source 20, and generates a high-voltage electrical pulse, as graphically shown in FIG. 3. Specifically, PV cell 16 will generate an electrical pulse having an amplitude of approximately 10,000 volts when radiated with a laser peak intensity of 1 $w/cm^2$, the pulse width being only a few milliseconds in duration, preferably, 2 milliseconds which corresponds to the pulse width of the laser pulse. Due to the typical impedance of the recipient's skin, with electrodes 18 preferably being spaced approximately 0.2 inches, the electrical pulse will provide a current of only a few milliamperes. This electrical pulse is sufficient to stun a typical human being, however, it is not sufficient to be lethal.

Energy source 20 preferably comprises a diode laser emitting a beam at an optical wavelength of 1540 nm such that it will not injure the human eye if accidently aimed into an assailant's face. The laser energy is preferably around one Joule. This energy is sufficient to stun the human body when converted to an electrical pulse, without causing permanent damage. However, a beam of energy up to ten Joules is suitable. The length of electrodes 18 is only approximately 0.2 inches such that it cannot penetrate the assailant's skin beyond a non-injurious depth.

Photovotalaic cell 16 is preferably a concentrator cell that is well known in the art. In the preferred embodiment the cell is a photovotalaic cell disclosed in U.S. Pat. No. 3,975,632 to Glass et al and assigned to Bell Telephone Laboratories, Inc., the teachings of which are incorporated herein by reference. Electrodes/barbs 18 are preferably comprised of stainless steel. Laser 20 is preferably a diode laser, however, other lasers having different wavelengths and designs are suitable for use with the present invention. It is only necessary that the photovotalaic cell 16 be matched and receptive to the energy source 20 such that it is tuned to the appropriate wavelength. While a single shot gun 12 is shown, many types of projectors could be implemented such as semi-automatic, rapid fire machine guns, pyrotechnic or smokess powder launchers. Laser energy source 20 preferably generates a pulsed light source, but could be comprised of free electrons, gas excimer, dye, Junction diodes, etc.

In operation, launcher 12 is utilized to project dart 10 at an intended target 24. The target may be acquired by a laser dot range finder (not shown). Laser source 20 then projects a pulsed light source 30 having an energy of one Joule or more at the photovotalaic cell 16 of dart 10. The PV cell 16 converts the pulsed laser beam photons into a high-energy electrical photovoltage pulse of sufficient magnitude to stun the target.

One advantage to the present invention is that a trailing lead need not be implemented with dart 10, as required by prior art devices. Rather, a PV cell 16 is implemented to convert an coherent light source energy to a photovoltage pulse. No trailing art devices. Rather, a PV cell 16 is implemented to convert an coherent light source energy to a photovoltage pulse. No trailing wires are required. In addition, the present invention has a long operational range, exceeding 25 feet. The range of the present invention is only limited by the laser spot diameter, and the ability of the user to focus the light beam on PV cell 16.

This invention has been described herein in considerable detail in order to comply with the Patent Statutes and to provide those skilled in the art with the information needed to apply the novel principles and to construct and use such specialized components as are required. However, it is to be understood that the invention can be carried out by specifically different equipment and devices, and that various modifications, both as to the equipment details and operating procedures, can be accomplished without departing from the scope of the invention itself.

What is claimed is:

1. A projectile suited to be propelled from a projector, comprising:

(a) a shroud having a proximal end and a distal end;

(b) body piercing means coupled to said shroud distal end for piercing a body surface when projected thereagainst; and (c) energy conversion means located at said shroud proximal end for converting a coherent electromagnetic energy to an electrical photovoltage, and for providing said electrical photovoltage to said body piercing means for stunning the body.

2. The projectile as specified in claim 1, wherein said body piercing means comprises a pair of barbs extending from said shroud distal end, said pair of barbs serving as electrodes.

3. The projectile as specified in claim 1, wherein said energy conversion means comprises a photovoltaic cell.

4. The projectile specified in claim 1 wherein said photovoltage outputted by said energy conversion means is approximately 10,000 volts.

5. In combination, a projector having means for projecting a projectile, and means for generating a coherent beam of electromagnetic energy; and a projectile comprising:

(a) a shroud having a proximal end and a distal end;

(b) body piercing means coupled to said shroud distal end for piercing a body surface when projected thereagainst; and (c) energy conversion means located at said shroud proximal end for converting the coherent beam of electromagnetic energy to an electrical photovoltage, and for providing said electrical photovoltage to said body piercing means for stunning the body.

6. The combination specified in claim 5, wherein said body piercing means comprises a pair of barbs extending from said shroud distal end, said pair of barbs serving as electrodes.

7. The combination as specified in claim 5, wherein said energy conversion means comprises a photovoltaic cell.

8. The combination specified in claim 5 wherein said electrical photovoltage outputted by said photovoltage is approximately 10,000 volts.

9. The combination as specified in either of claims 1 or 5 wherein said beam of coherent electromagnetic energy has a wavelength in the infrared spectrum.

10. The combination as specified in claim 9 wherein said wavelength is approximately 1540 nm.

11. The combination as specified in either of claim 5 said means for generating a coherent beam of electromagnetic energy comprises a pulsed laser.

* * * * *